US008664875B1

(12) United States Patent
Chang

(10) Patent No.: US 8,664,875 B1
(45) Date of Patent: Mar. 4, 2014

(54) LED CONTROL CIRCUIT WITH AUTO ON/OFF FUNCTION

(75) Inventor: Chucheng Chang, Hsinchu (TW)

(73) Assignee: Polestar Electric Industries Co., Ltd., Guangdong (CN)

( * ) Notice: Subject to any disclaimer, the term of this patent is extended or adjusted under 35 U.S.C. 154(b) by 4 days.

(21) Appl. No.: 13/594,493

(22) Filed: Aug. 24, 2012

(51) Int. Cl.
*H05B 41/36* (2006.01)

(52) U.S. Cl.
USPC ..... 315/224

(58) Field of Classification Search
None
See application file for complete search history.

(56) References Cited

U.S. PATENT DOCUMENTS

| | | | | |
|---|---|---|---|---|
| 4,788,474 | A * | 11/1988 | Kokubu et al. | 315/119 |
| 5,550,436 | A * | 8/1996 | Houk | 315/209 R |
| 5,757,141 | A * | 5/1998 | Wood | 315/224 |
| 6,617,801 | B2 * | 9/2003 | Ishizuka et al. | 315/169.3 |
| 6,841,950 | B1 * | 1/2005 | Walker | 315/169.3 |
| 7,067,992 | B2 * | 6/2006 | Leong et al. | 315/291 |
| 7,378,804 | B2 * | 5/2008 | Mitsuyasu et al. | 315/247 |
| 7,525,256 | B2 * | 4/2009 | Ribarich et al. | 315/209 R |
| 7,741,786 | B2 * | 6/2010 | Lee | 315/157 |
| 7,952,296 | B2 * | 5/2011 | Yu et al. | 315/224 |
| 8,148,908 | B2 * | 4/2012 | Lai | 315/247 |
| 8,212,485 | B2 * | 7/2012 | Elek et al. | 315/130 |
| 8,344,635 | B2 * | 1/2013 | Gao | 315/224 |
| 2002/0175634 | A1 * | 11/2002 | Ishizuka et al. | 315/169.1 |
| 2006/0158131 | A1 * | 7/2006 | Mitsuyasu et al. | 315/209 R |
| 2007/0029945 | A1 * | 2/2007 | Yu et al. | 315/224 |
| 2007/0228999 | A1 * | 10/2007 | Kit | 315/291 |
| 2008/0290814 | A1 * | 11/2008 | Leong et al. | 315/294 |
| 2009/0085495 | A1 * | 4/2009 | Yamauchi et al. | 315/291 |
| 2009/0302775 | A1 * | 12/2009 | Alexandrov | 315/224 |
| 2010/0176733 | A1 * | 7/2010 | King | 315/158 |
| 2010/0308749 | A1 * | 12/2010 | Liu | 315/307 |
| 2011/0037391 | A1 * | 2/2011 | Lai | 315/119 |
| 2011/0062888 | A1 * | 3/2011 | Bondy et al. | 315/294 |
| 2011/0101879 | A1 * | 5/2011 | McNay | 315/247 |
| 2013/0063047 | A1 * | 3/2013 | Veskovic | 315/307 |

* cited by examiner

*Primary Examiner* — Crystal L Hammond
(74) *Attorney, Agent, or Firm* — Ming Chow; Sinorica, LLC

(57) ABSTRACT

An LED control circuit with auto ON/OFF function has a power module, a control module, a timer module, a driver module and an LED module with a first LED unit and a second LED unit. The control module generates a time control signal and an LED control signal to respectively activate the timer module and the LED module. The LED module is activated by the LED control signal only when the timer module is turned ON. The timer module can be automatically turned ON/OFF by the time control signal. Moreover, the LED control signal has high potentials and low potentials. The driver module activates the first LED unit and the second LED unit based on two the different potentials of the LED control signal respectively. Both high and low potentials of the LED control are used. The performance of the LED module is improved.

20 Claims, 5 Drawing Sheets

LED CONTROL CIRCUIT WITH AUTO ON/OFF FUNCTION

BACKGROUND OF THE INVENTION

1. Field of the Invention

The present invention relates to an LED control circuit, and more particularly to an LED control circuit with auto ON/OFF function.

2. Description of Related Art

A light-emitting diode (LED) device has advantages of high brightness and low power dissipation. The LEDs can be applied for illumination and decoration. For example, an LED string can have multiple LED devices connected in series. Such LED string can be used as a decoration light string during festive occasions.

The LED device is an electric device that is activated by a forward bias voltage. For example, the LED string can be activated by a PWM signal. The PWM signal comprises multiple high potentials and low potentials changed alternately. The LED string is activated in the high potentials but inactivated in the low potentials. Therefore, the LED string flashes.

However, the flashing performance of the LED string is poor because the LED string is only activated in the high potentials of the PWM signal. The LED string is not actuated in the low potentials. Hence, the use of the PWM signal is inefficient.

In additional, the LED string is usually connected to a power source via a switch. In the daytime, the LED string does not need to be activated. A user can press the switch to turn OFF the LED string. At night, the user has to press the button again to turn ON the LED string. The user may press the button several times in a day, especially in a shopping area where variations in flow of customers need to be taken into account. Hence, it is inconvenient for the user to manually turn ON/OFF the LED string.

SUMMARY OF THE INVENTION

An objective of the LED control circuit of the present invention is to improve the illumination efficiency of the LED module and to automatically turn ON/OFF the LED module.

The LED control circuit of the present invention comprises a power module, a control module, a timer module, a driver module and an LED module.

The power module provides a working voltage.

The control module is connected to the power module to receive the working voltage and synchronously generates a time control signal and an LED control signal. The LED control signal comprises multiple high potentials and low potentials changed alternately.

The timer module is connected to the power module and the control module and is activated by the time control signal.

The driver module is connected to the timer module and is activated by the LED control signal.

The LED module is connected to the driver module and has at least one LED assembly. The LED assembly comprises a first LED unit and a second LED unit. The first LED unit has an anode and a cathode. The second LED unit has an anode and a cathode. The anode of the second LED unit is connected to the cathode of the first LED unit. The cathode of the second LED unit is connected to the anode of the first LED unit.

The controller automatically turns ON and OFF the timer module according to the time control signal to connect or disconnect the LED module to or from the power module at certain times. The LED module is activated by the LED control signal only when the timer module is turned ON. The first LED unit and the second LED unit are respectively activated by the high and low potentials of the LED control signal through the driver module.

The LED control circuit of the present invention has advantages of:

1. The timer module can be turned ON/OFF by the time control signal. When the timer module is turned ON, the LED module can be connected to the power module to receive the working voltage. When the timer module is turned OFF, the LED module is disconnected from the power module to be inactivated. Hence, the user can setup a working time of the time control signal. The control module then automatically turns ON/OFF the LED module at a certain time.

2. Both the high potentials and the low potentials of the LED control signal can activate the LED module. Because both of the potentials are efficiently used, the performance of the LED module is beneficial.

DETAILED DESCRIPTION OF THE PREFERRED EMBODIMENT

Figure 1:
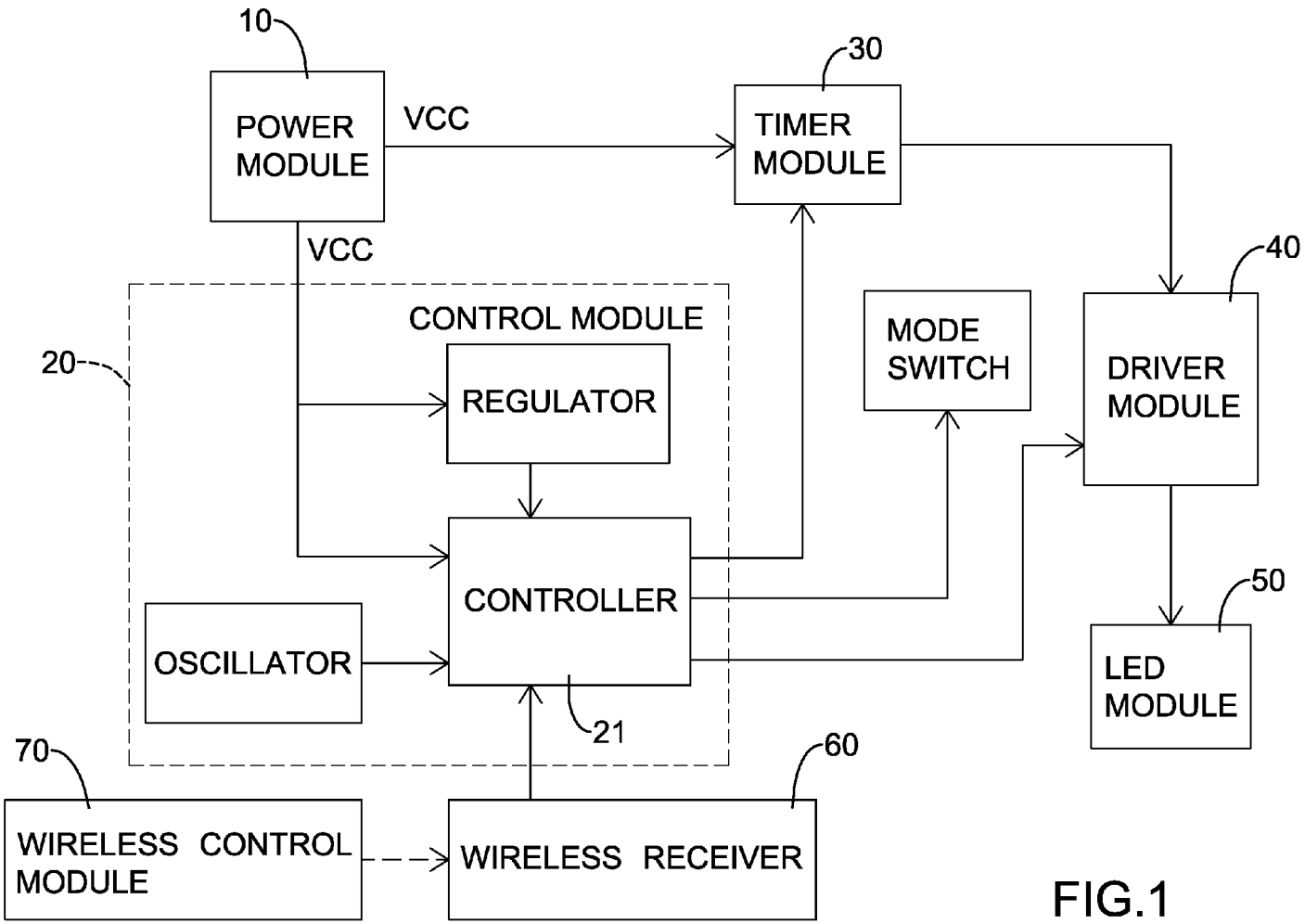
FIG. 1 is a block diagram of an LED control circuit of the present invention.
Figure 2:
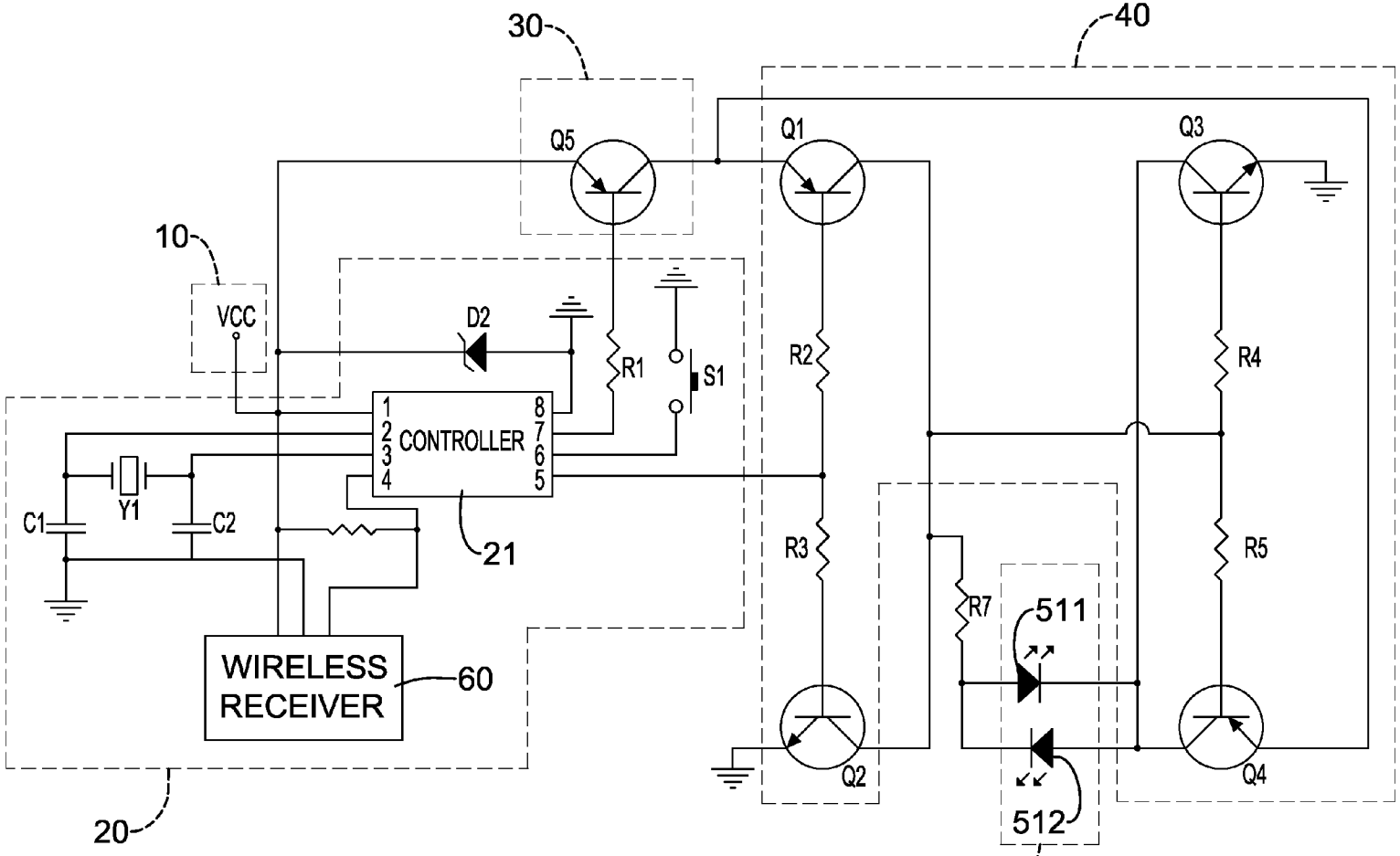
FIG. 2 is a detailed circuit diagram of a first embodiment of the present invention.
Figure 4:
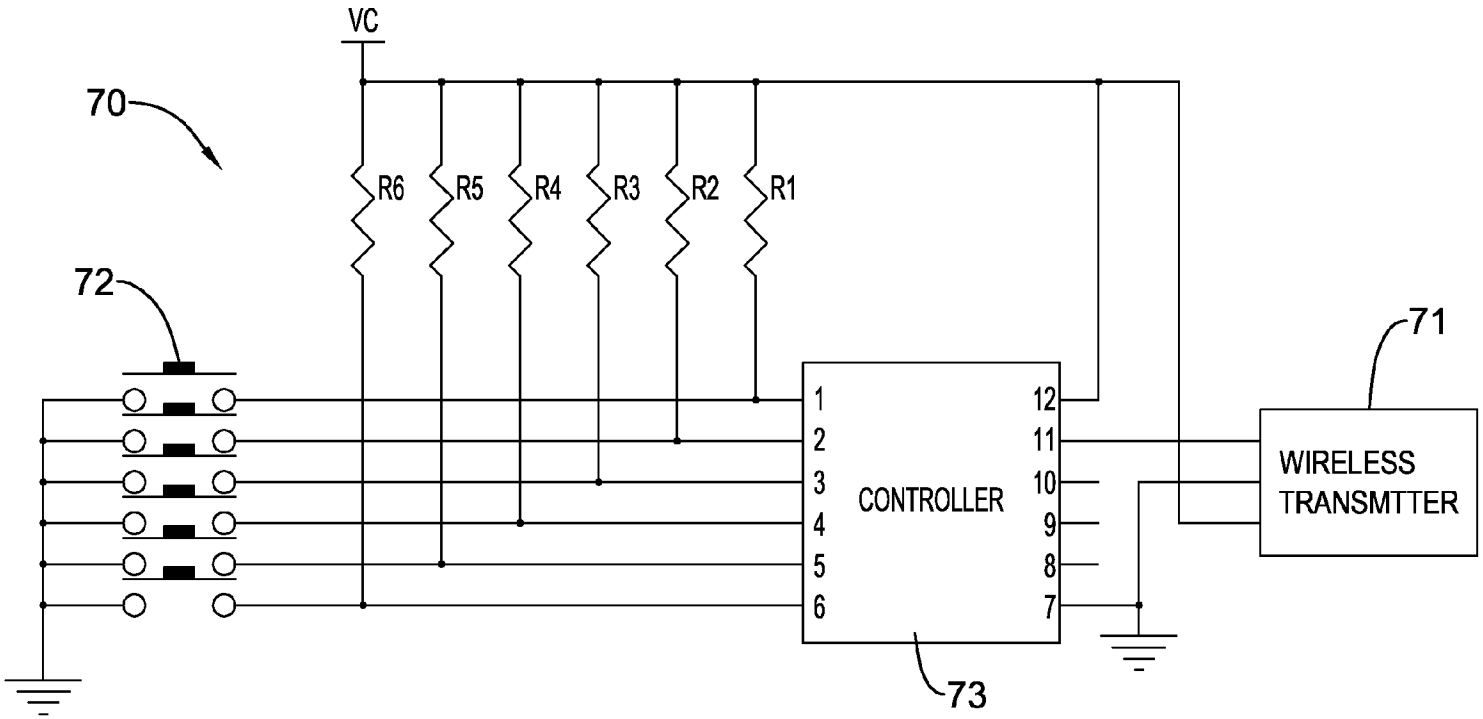
FIG. 4 is a detailed circuit diagram of a wireless control module of the present invention.

With reference to FIGS. 1, 2 and 4, the LED control circuit of the present invention comprises a power module 10, a control module 20, a timer module 30, a driver module 40, an LED module 50, a wireless receiver 60 and a wireless control module 70.

The power module 10 is electrically connected to the control module 20, the timer module 30, the driver module 40, the LED module 50 and the wireless receiver 60 to provide a working voltage VCC. In this embodiment, the working voltage VCC is positive.

The control module 20 has an oscillator Y1, a mode switch S1, a controller 21 and a regulator D2.

The oscillator Y1 has two terminals and generates a clock signal.

The mode switch S1 can be a normally open switch.

With reference to FIG. 2, the controller 21 has multiple input pins and multiple output pins. The input pins include a first pin, a second pin, a third pin, a fourth pin, a sixth pin and an eighth pin. The output pins include a fifth pin and a seventh pin.

The first pin and the eighth pin are power pins. The first pin is connected to the power module 10 to receive the working voltage VCC. The eighth pin is grounded. The controller 21 is activated by the working voltage VCC.

The second pin and the third pin are respectively connected to the two terminals of the oscillator Y1 to receive the clock signal.

The fourth pin is connected to the wireless receiver 60 to receive signals from the wireless control module 70.

The sixth pin is connected to the mode switch S1.

The wireless control module 70 has a wireless transmitter 71, multiple buttons 72 and a controller 73. The wireless transmitter 71 wirelessly communicates with the wireless receiver 60. The controller 73 stores multiple mode signals and is electrically connected to the buttons 72 and the wireless transmitter 71. The controller 73 of the wireless control module 70 sends the mode signal to the controller 21 of the control module 20 via the wireless transmitter 71 according to the button 72 which is pressed by a user.

When the controller 21 is working, the controller 21 generates an LED control signal and a time control signal. The clock signal of the oscillator Y1 is a reference for normalizing the timing of the LED control signal and the time control signal, so that the clock signal is adapted to synchronize the LED control signal with the time control signal.

Figure 5:
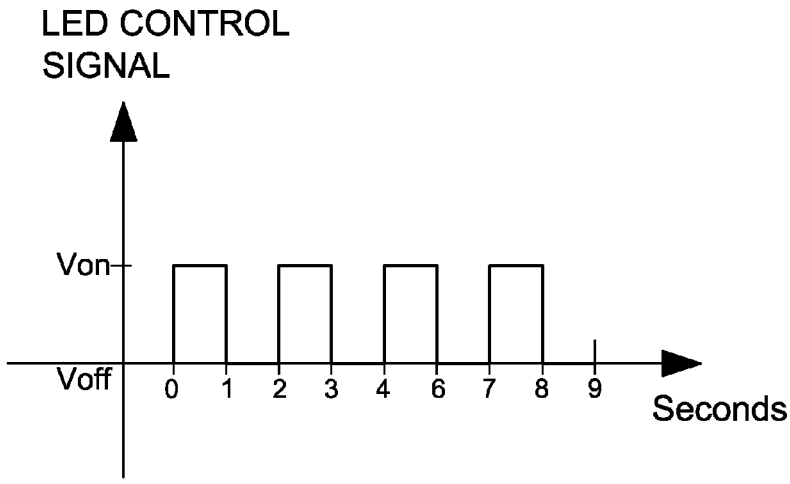
FIG. 5 is a wave diagram of the LED control signal.

The LED control signal is sent out via the fifth pin and is a PWM signal comprising multiple high potentials and multiple low potentials changed alternately. With reference to FIG. 5, the high potentials (Von) and the low potentials (Voff) respectively perform in short intervals, such as seconds. Under the control of the LED control signal, the LED module 50 may be operated in a full light mode, a repeating mode or a flashing mode. The modes are changed sequentially when the mode switch S1 is pressed or changed according the mode signal sent from the wireless control module 70.

Figure 6:
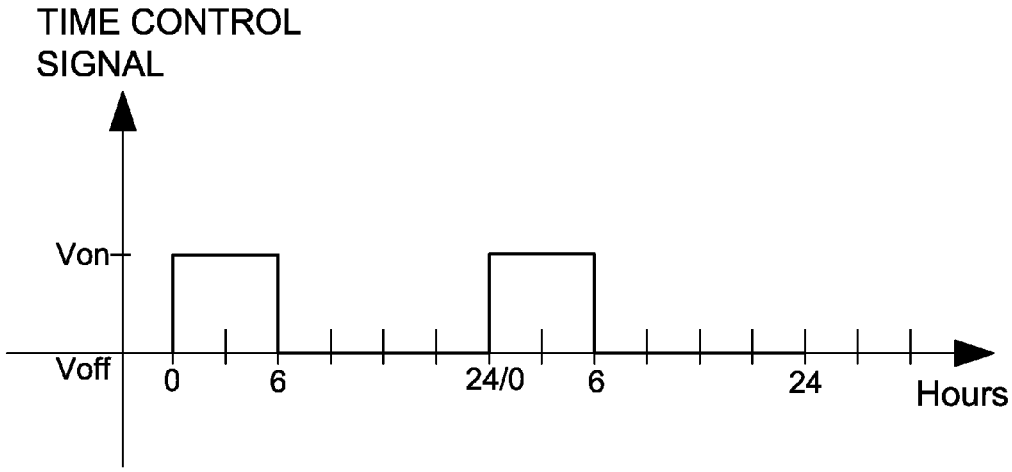
FIG. 6 is a wave diagram of the time control signal.

The time control signal is sent out via the seventh pin and comprises high potentials and low potentials changed alternately. With reference to FIG. 6, the high potentials (Von) and the low potentials (Voff) are respectively maintained for a certain time, such as several hours. For example, the low potential occurs in the night while the high potential occurs in the daytime.

The regulator D2 can be a Zener diode and is connected between the first pin and the eighth pin of the controller 21. The regulator D2 is used to protect the controller 21 from unusually high voltages.

The timer module 30 is connected to the power module 10 in series. In this embodiment, the timer module 30 has a fifth electric switch Q5 which is a PNP bipolar junction transistor (BJT). The fifth electric switch Q5 has a base, an emitter and a collector. The emitter is connected to the power module 10. The base is connected to the seventh pin through a resistor R1 to receive the time control signal from the controller 21. When the fifth electric switch Q5 receives the low potentials of the time control signal, the fifth switch Q5 is turned ON.

The driver module 40 is connected to the timer module 30 in series. In this embodiment, the driver module 40 has a first electric switch Q1, a second electric switch Q2, a third electric switch Q3 and a fourth electric switch Q4. In the embodiment, the first electric switch Q1 and the fourth electric switch Q4 are PNP BJT having a base, a collector and an emitter respectively. The second electric switch Q2 and the third electric switch Q3 are NPN BJT having a base, a collector and an emitter respectively.

The base of the first electric switch Q1 is connected to the fifth pin of the controller 21 through a resistor R2 to receive the LED control signal. The emitter of the first electric switch Q1 is connected to the collector of the fifth electric switch Q5.

The base of the second electric switch Q2 is connected to the fifth pin of the controller 21 through a resistor R3 to receive the LED control signal. The emitter of the second electric switch Q2 is grounded. The collector of the second electric switch Q2 is connected to the collector of the first electric switch Q1.

The base of the third electric switch Q3 is connected to the collector of the first electric switch Q1 through a resistor R4. The emitter of the third electric switch Q3 is grounded.

The base of the fourth electric switch Q4 is connected to the collector of the second electric switch Q2 through a resistor R5. The emitter of the fourth electric switch Q4 is connected to the collector of the fifth electric switch Q5. The collector of the fourth electric switch Q4 is connected to the collector of the third electric switch Q3.

Figure 3:
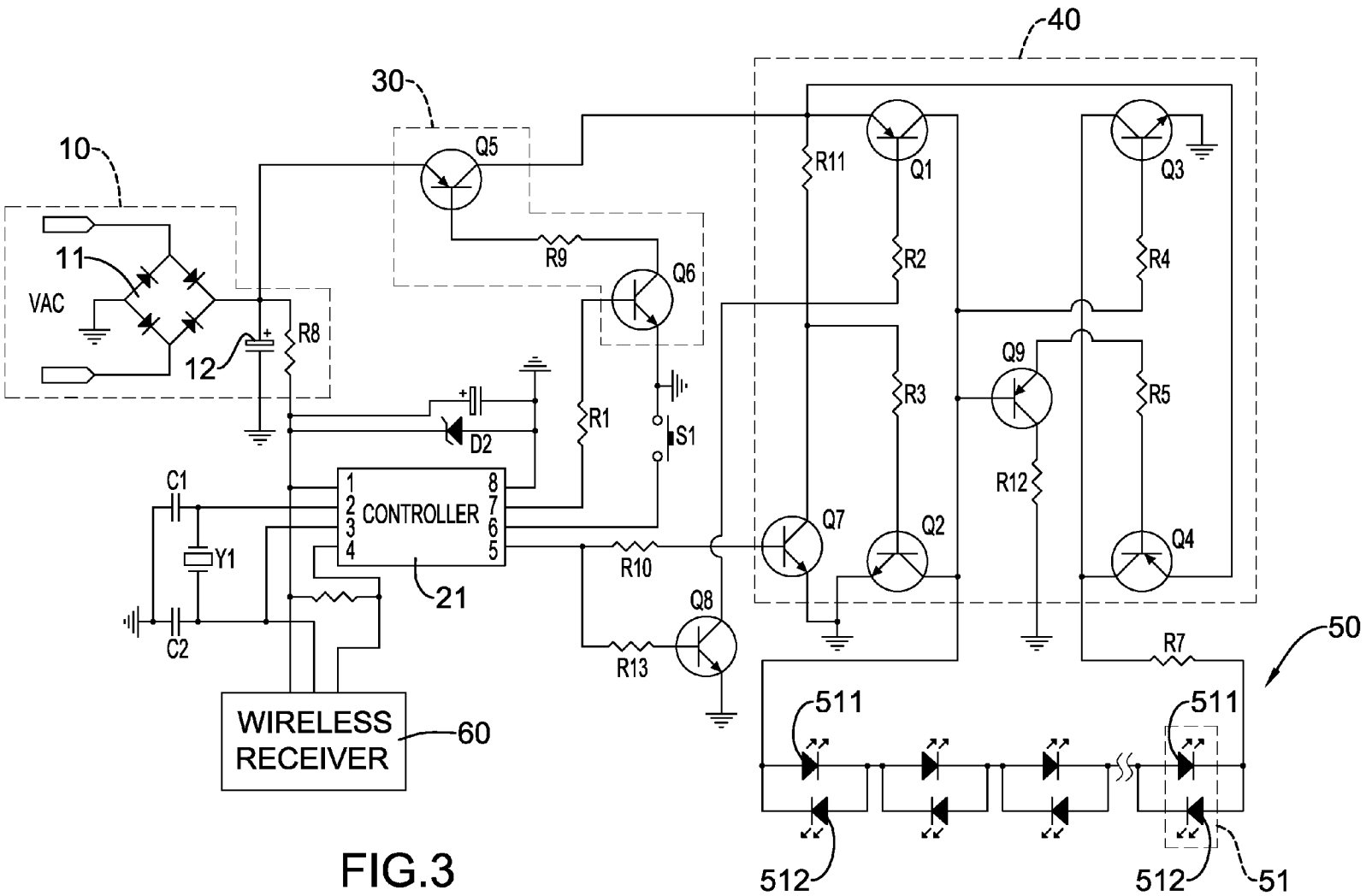
FIG. 3 is a detailed circuit diagram of a second embodiment of the present invention.

The LED module 50 is connected to the driver module 40 and comprises at least one LED assembly 51. The LED assembly 51 has a first LED unit 511 and a second LED unit 512. In the first embodiment, the LED module 50 has an LED assembly 51. With reference to FIG. 3 of a second embodiment, the LED module 50 has multiple LED assemblies 51 connected in series.

With reference to FIG. 2, the first LED unit 511 can be a single LED device or have multiple LED devices connected in series. The first LED unit 511 has an anode and a cathode. The anode is connected to the collector of the first electric switch Q1 through a resistor R7. The cathode is connected to the collector of the third electric switch Q3.

The second LED unit 512 can be an LED device or have multiple LED devices connected in series. The second LED unit 512 has an anode and a cathode. The anode of the second LED unit 512 is connected to the collector of the fourth electric switch Q4 and the cathode of the first LED unit 511. The cathode of the second LED unit 512 is connected to the anode of the first LED unit 511.

During the high potentials of the LED control signal, the first electric switch Q1 and the third electric switch Q3 are turned OFF. The second electric switch Q2 and the fourth electric switch Q4 are turned ON. The power module 10, the fifth electric switch Q5, the fourth electric switch Q4, the second LED unit 512 and the second electric switch Q2 then form a first current loop. Therefore, the second LED unit 512 is activated to light up.

During the low potentials of the LED control signal, the first electric switch Q1 and the third electric switch Q3 are turned ON. The second electric switch Q2 and the fourth electric switch Q4 are turned OFF. The power module 10, the fifth electric switch Q5, the first electric switch Q1, the first LED unit 511 and the third electric switch Q3 then form a second current loop. Therefore, the first LED unit 511 is activated to light up.

The first LED unit 511 is activated by the low potentials of the LED control signal. The second LED unit 512 is activated by the high potentials of the LED control signal. Because the high potentials and the low potentials of the LED control signal are efficiently used, the illumination performance of the LED module 50 can be improved.

As long as the low potential of the time control signal ends, the time control signal turns into the high potential. The fifth electric switch Q5 is then turned off due to the high potential of the time control signal. When the fifth electric switch Q5 is turned OFF, the LED module 50 is disconnected from the power module 10 and cannot receive the working voltage from the power module 10. The LED module 50 is then inactivated.

In conclusion, the LED module 50 can be activated by the LED control signal only when the timer module 30 is turned ON by the time control signal.

With reference to FIG. 3, the power module 10 of the second embodiment comprises a rectifier 11 and a filter 12. The rectifier 11 has an input and an output. The input is connected to a power source to receive an input power VAC. The output is connected to the first pin of the controller 21 through a resistor R8. The rectifier 11 converts the input power VAC to the working voltage VCC. The filter 12 is connected to the output of the rectifier 11 in parallel to filter electrical noises.

The timer module 30 of the second embodiment has a fifth electric switch Q5 and a sixth electric switch Q6. In this embodiment, the fifth electric switch Q5 is a PNP BJT and the sixth electric switch Q6 is an NPN BJT. The fifth electric switch Q5 and the sixth electric switch Q6 respectively have a base, a collector and an emitter.

The emitter of the fifth electric switch Q5 is connected to the output of the rectifier 11. The base of the sixth electric switch Q6 is connected to the seventh pin of the controller 21 through a resistor R1 to receive the time control signal. The emitter of the sixth electric switch Q6 is grounded. The collector of the sixth electric switch Q6 is connected to the base of the fifth electric switch Q5 through a resistor R9. The sixth electric switch Q6 can be turned ON by the high potentials of the time control signal.

The driver module 40 of the second embodiment has a first electric switch Q1 of a PNP BJT, a second electric switch Q2 of an NPN BJT, a third electric switch Q3 of an NPN BJT, a fourth electric switch Q4 of a PNP BJT, a seventh electric switch Q7 of an NPN BJT, an eighth electric switch Q8 of an NPN BJT and a ninth electric switch Q9 of a PNP BJT. The electric switches Q1-Q4, Q7-Q9 respectively have a base, a collector and an emitter.

The base of the seventh electric switch Q7 is connected to the fifth pin of the controller 21 through a resistor R10 to receive the LED control signal. The emitter of the seventh switch Q7 is grounded. The collector of the seventh switch Q7 is connected to the collector of the fifth electric switch Q5 through a resistor R11.

The base of the eighth electric switch Q8 is connected to the fifth pin of the controller 21 through a resistor R13 to receive the LED control signal. The emitter of the eighth electric switch Q8 is grounded.

The base of the first electric switch Q1 is connected to the collector of the eighth electric switch Q8 through a resistor R2. The emitter of the first electric switch Q1 is connected to the collector of the fifth electric switch Q5.

The base of the second electric switch Q2 is connected to the collector of the seventh electric switch Q7 through a resistor R3. The emitter of the second electric switch Q2 is grounded. The collector of the second electric switch Q2 is connected to the collector of the first electric switch Q1 and the cathode of the first LED unit 511.

The base of the third electric switch Q3 is connected to the collector of the first electric switch Q1 through a resistor R4. The emitter of the third electric switch Q3 is grounded.

The base of the ninth electric switch Q9 is connected to the collector of the second electric switch Q2. The collector of the ninth electric switch Q9 is grounded through a resistor R12.

The base of the fourth electric switch Q4 is connected to the emitter of the ninth electric switch Q9 through a resistor R5. The emitter of the fourth electric switch Q4 is connected to the collector of the fifth electric switch Q5. The collector of the fourth electric switch Q4 is connected to the collector of the third electric switch Q3 and the anode of the first LED unit 511.

During the high potentials of the LED control signal, the seventh electric switch Q7 and the eighth electric switch Q8 are turned ON. The collectors of the seventh and the eighth electric switch Q7, Q8 stay at a low potential. Therefore, the first electric switch Q1 can be turned ON and the second electric switch Q2 can be turned OFF. The power module 10, the fifth electric switch Q5, the first electric switch Q1, the first LED units 511 and the third electric switch Q3 form a third current loop, wherein the collector current of the fifth electric switch Q5 can be regarded as the current of the third current loop. The first LED units 511 are then activated to light up.

During the low potentials of the LED control signal, the seventh and the eighth electric switch Q7, Q8 are turned OFF. The collectors of the seventh and the eighth electric switch Q7, Q8 keep at a high potential. Therefore, the first electric switch Q1 can be turned OFF and the second electric switch Q2 can be turned ON. The power module 10, the fifth electric switch Q5, the fourth electric switch Q4, the second LED units 512 and the second electric switch Q2 then form a fourth current loop, wherein the collector current of the fifth electric switch Q5 can be regarded as the current of the fourth current loop. The second LED units 512 are then activated to light up.

In the second embodiment, the sixth electric switch Q6 and the seventh electric switch Q7 are used to increase the current of the current loops. Taking the timer module 30 of the second embodiment as an example, the fifth electric switch Q5 is driven by the sixth electric switch Q6. In general, a collector current is β times greater than a base current of a BJT. The collector current of the sixth electric switch Q6 is regarded as the base current of the fifth electric switch Q5. Therefore, the collector current of the fifth electric switch Q5 of the second embodiment is approximately β times greater than that of the first embodiment. Because the current loops of the second and the third embodiment are increased, the LED control circuit is capable of lighting more LED units 511, 512.

What is claimed is:

1. An LED control circuit with auto ON/OFF function comprising:

a power module providing a working voltage;

a control module connected to the power module to receive the working voltage and synchronously generating:

a time control signal; and an LED control signal comprising multiple high potentials and low potentials changed alternately;

a timer module connected to the power module and the control module and activated by the time control signal;

a driver module connected to the timer module and activated by the LED control signal; and an LED module connected to the driver module and having at least one LED assembly, wherein the LED assembly comprises:

a first LED unit having an anode and a cathode; and a second LED unit having:

an anode connected to the cathode of the first LED unit; and a cathode connected to the anode of the first LED unit;

wherein the controller automatically turns ON and OFF the timer module according to the time control signal to connect or disconnect the LED module to or from the power module at certain times; the LED module is activated by the LED control signal only when the timer module is turned ON; the first LED unit and the second LED unit are respectively activated by the high and low potentials of the LED control signal through the driver module.

2. The LED control circuit as claimed in claim 1, the control module comprising:

an oscillator generating a clock signal; and a controller connected to the power module, the oscillator, the timer module and the driver module to receive the working voltage, receive the clock signal, generate the time control signal and generate the LED control signal, wherein the clock signal synchronizes the LED control signal with the time control signal.

3. The LED control circuit as claimed in claim 2, the control module further comprising a regulator connected to the power module and the controller.

4. The LED control circuit as claimed in claim 3, the power module comprising:

a rectifier converting an input power to the working voltage; and a filter connected to the rectifier in parallel.

5. The LED control circuit as claimed in claim 4, wherein the timer module is a fifth electric switch of a PNP BJT having:

a base connected to the controller to receive the time control signal;

a collector connect to the driver module; and an emitter connected to the rectifier.

6. The LED control circuit as claimed in claim 5, the driver module comprising:

a first electric switch of a PNP BJT having:

a base connected to the controller to receive the LED control signal;

a collector connected to the anode of the first LED unit; and an emitter connected to the collector of the fifth electric switch;

a second electric switch of an NPN BJT having:

a base connected to the controller to receive the LED control signal;

a collector connected to the collector of the first electric switch; and an emitter being grounded;

a third electric switch of an NPN BJT having:

a base connected to the collector of the first electric switch;

a collector connected to the cathode of the first LED unit; and an emitter being grounded; and a fourth electric switch of a PNP BJT having:

a base connected to the collector of the second electric switch;

a collector connected to the collector of the third electric switch; and an emitter connected to the collector of the fifth electric switch.

7. The LED control circuit as claimed in claim 6, wherein the LED control signal has multiple modes controlled by a mode switch connected to the controller.

8. The LED control circuit as claimed in claim 6 further comprising:

a wireless receiver connected to the controller of the control module; and a wireless control module having:

a wireless transmitter wirelessly communicating with the wireless receiver;

multiple buttons; and a controller storing multiple mode signals and electrically connected to the buttons and the wireless transmitter and sending the mode signal to the controller of the control module via the wireless transmitter according to the button which is pressed, wherein the LED control signal of the controller of the control module has multiple modes controlled by the mode signals.

9. The LED control circuit as claimed in claim 5, wherein the LED control signal has multiple modes controlled by a mode switch connected to the controller.

10. The LED control circuit as claimed in claim 5 further comprising:

a wireless receiver connected to the controller of the control module; and a wireless control module having:

a wireless transmitter wirelessly communicating with the wireless receiver;

multiple buttons; and a controller storing multiple mode signals and electrically connected to the buttons and the wireless transmitter and sending the mode signal to the controller of the control module via the wireless transmitter according to the button which is pressed, wherein the LED control signal of the controller of the control module has multiple modes controlled by the mode signals.

11. The LED control circuit as claimed in claim 4, wherein the timer module has:

a fifth electric switch of a PNP BJT and having:

a base;

a collector connected to the driver module; and an emitter connected to the rectifier; and a sixth electric switch of an NPN BJT and having:

a base connected to the controller to receive the time control signal;

a collector connected to the base of the fifth electric switch; and an emitter being grounded.

12. The LED control circuit as claimed in claim 11, the driver module comprising:

a seventh electric switch of an NPN BJT having:

a base connected to the controller to receive the LED control signal;

an emitter being grounded; and a collector connected to the collector of the fifth electric switch;

an eighth electric switch of an NPN BJT having:

a base connected to the controller to receive the LED control signal;

an emitter being grounded; and a collector;

a first electric switch of a PNP BJT having:

a base connected to the collector of the eighth electric switch;

an emitter connected to the collector of the fifth electric switch; and a collector;

a second electric switch of an NPN BJT having:

a base connected to the collector of the seventh electric switch;

an emitter being grounded; and a collector connected to the collector of the first electric switch and the cathode of the first LED unit;

a third electric switch of an NPN BJT having:

a base connected to the collector of the first electric switch;

an emitter being grounded; and a collector;

a ninth electric switch of a PNP BJT having:

a base connected to the collector of the second electric switch;

a collector being grounded; and an emitter; and a fourth electric switch of a PNP BJT having:

a base connected to the emitter of the ninth electric switch;

an emitter connected to the collector of the fifth electric switch; and a collector connected to the collector of the third electric switch and the anode of the first LED unit.

13. The LED control circuit as claimed in claim 12, wherein the LED control signal has multiple modes controlled by a mode switch connected to the controller.

14. The LED control circuit as claimed in claim 12 further comprising:

a wireless receiver connected to the controller of the control module; and a wireless control module having:

a wireless transmitter wirelessly communicating with the wireless receiver;

multiple buttons; and a controller storing multiple mode signals and electrically connected to the buttons and the wireless transmitter and sending the mode signal to the controller of the control module via the wireless transmitter according to the button which is pressed, wherein the LED control signal of the controller of the control module has multiple modes controlled by the mode signals.

15. The LED control circuit as claimed in claim 11, wherein the LED control signal has multiple modes controlled by a mode switch connected to the controller.

16. The LED control circuit as claimed in claim 11 further comprising:

a wireless receiver connected to the controller of the control module; and a wireless control module having:

a wireless transmitter wirelessly communicating with the wireless receiver;

multiple buttons; and a controller storing multiple mode signals and electrically connected to the buttons and the wireless transmitter and sending the mode signal to the controller of the control module via the wireless transmitter according to the button which is pressed, wherein the LED control signal of the controller of the control module has multiple modes controlled by the mode signals.

17. The LED control circuit as claimed in claim 4, wherein the LED control signal has multiple modes controlled by a mode switch connected to the controller.

18. The LED control circuit as claimed in claim 4 further comprising:

a wireless receiver connected to the controller of the control module; and a wireless control module having:

a wireless transmitter wirelessly communicating with the wireless receiver;

multiple buttons; and a controller storing multiple mode signals and electrically connected to the buttons and the wireless transmitter and sending the mode signal to the controller of the control module via the wireless transmitter according to the button which is pressed, wherein the LED control signal of the controller of the control module has multiple modes controlled by the mode signals.

19. The LED control circuit as claimed in claim 2, wherein the LED control signal has multiple modes controlled by a mode switch connected to the controller.

20. The LED control circuit as claimed in claim 2 further comprising:

a wireless receiver connected to the controller of the control module; and a wireless control module having:

a wireless transmitter wirelessly communicating with the wireless receiver;

multiple buttons; and a controller storing multiple mode signals and electrically connected to the buttons and the wireless transmitter and sending the mode signal to the controller of the control module via the wireless transmitter according to the button which is pressed, wherein the LED control signal of the controller of the control module has multiple modes controlled by the mode signals.

* * * * *